United States Patent [19]

Bringhurst

[11] 4,134,336

[45] Jan. 16, 1979

[54] HALF-HERRINGBONE SUPPORT FOR RESTRICTING SIDEWAYS VIBRATION OF COMB HAMMERS

[75] Inventor: Edward D. Bringhurst, Seattle, Wash.

[73] Assignee: Tally Corporation, Kent, Wash.

[21] Appl. No.: 779,364

[22] Filed: Mar. 21, 1977

[51] Int. Cl.[2] ..... B41J 5/12

[52] U.S. Cl. ..... 101/93.04; 400/124

[58] Field of Search ..... 101/93.02, 93.04, 93.18, 101/93.19, 110, 111; 197/1 R, 53

[56] References Cited

U.S. PATENT DOCUMENTS

| | | | |
|---|---|---|---|
| 3,768,403 | 10/1973 | Rose | 101/93 C |
| 3,782,278 | 1/1974 | Barnett et al. | 101/93.04 |
| 3,893,390 | 7/1975 | Deproux | 101/111 |
| 3,907,091 | 9/1975 | Meier et al. | 197/53 |

*Primary Examiner*—Ernest T. Wright, Jr.
*Attorney, Agent, or Firm*—Christensen, O'Connor, Johnson & Kindness

[57] ABSTRACT

A half-herringbone support for the comb hammers of a dot matrix line printer is disclosed. The half-herringbone support is generally flat and includes an elongate base and a series of parallel tines integrally formed with said base and projecting obliquely outwardly from one edge of the base. The number of half-herringbone tines is equal to the number of hammers. The base of the half-herringbone support is affixed to the base of the hammer support on the side containing the hammer anvils (balls). The outer tips of the half-herringbone tines project to a point where they each intersect the mid-region of a related hammer. The tips of the half-herringbone tines are welded to the hammers at the points of intersection. The portion of said half-herringbone tines passing over hammers other than the hammer to which a particular half-herringbone tine is welded are undercut to prevent rubbing between the half-herringbone tines and the hammers over which the half-herringbone tines pass, but with which they are not associated.

4 Claims, 6 Drawing Figures

Fig. 1.
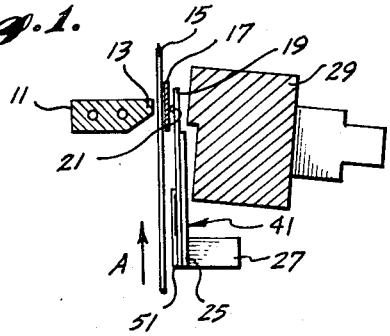
Fig. 2.
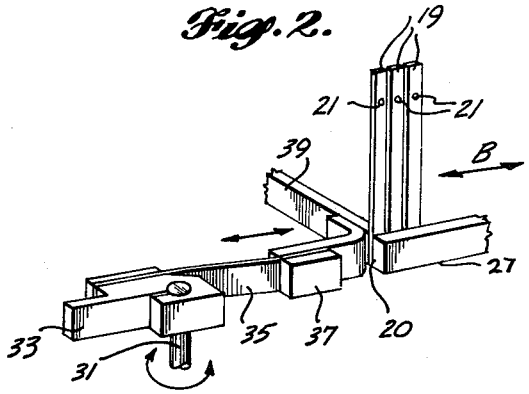
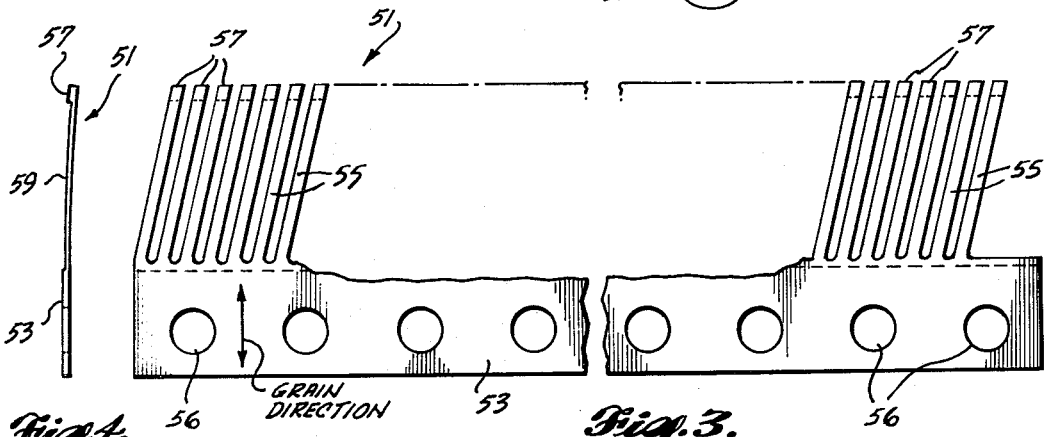
Fig. 4.
Fig. 3.
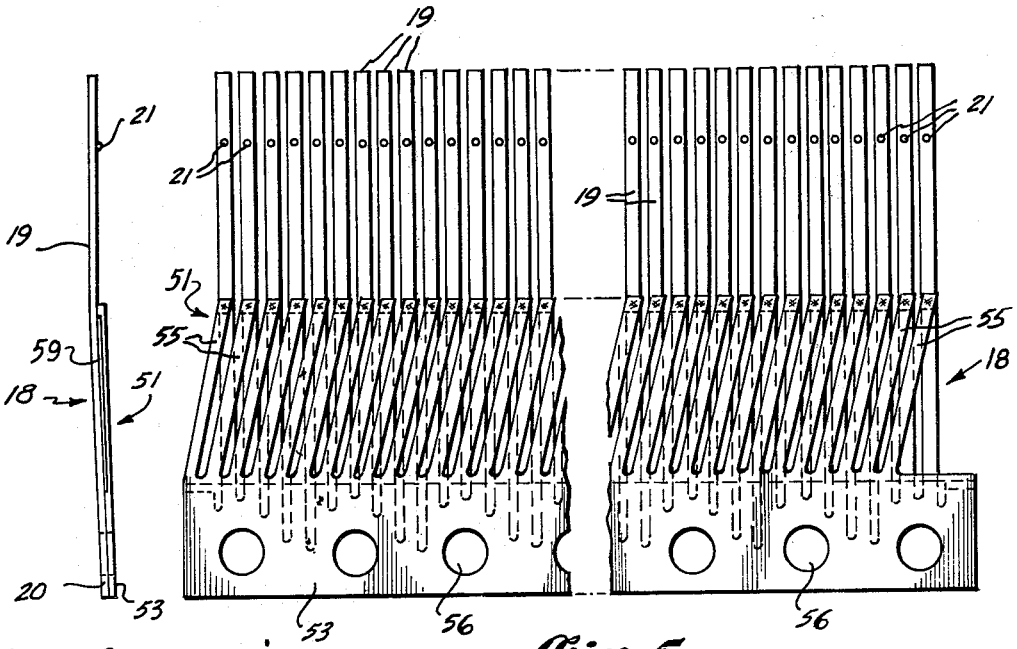
Fig. 6.
Fig. 5.

HALF-HERRINGBONE SUPPORT FOR RESTRICTING SIDEWAYS VIBRATION OF COMB HAMMERS

BACKGROUND OF THE INVENTION

The invention relates to dot matrix type line printers and, more particularly, dot matrix line printers that include a plurality of hammers formed by the tines of a "comb" that is oscillated back and forth along an axis that lies perpendicular to the axis of movement of the print paper.

Various types of line printers have been proposed and used. One type of line printer that has been found particularly well suited for use as an on-line or off-line remote terminal or direct hookup device includes a comb that is oscillated back and forth in a direction perpendicular to the direction of paper movement. The comb includes a base and a plurality of vertically oriented tines. The tines form the print hammers. Located near the outer end of each hammer is a print anvil, which may be in the form of a ball welded to each hammer. Located on the side of the comb remote from the anvil side are a plurality of print coils. One print coil may be dedicated to each hammer. The hammers are moved back and forth, i.e., in a direction perpendicular both to the direction of oscillatory movement of the comb and perpendicular to the direction of paper movement, by the selective energization of the print coils. Energization of the print coils causes the hammers and, thus, the anvils to be withdrawn. Release of the stored strain energy in the hammers causes the anvils to press a ribbon against the print paper and create a dot thereon. A row/column series of dots formed in this manner create alphanumeric (or other types of) characters. A printer of this general nature is the Series 2000 Line Printer sold by the Tally Corporation, Kent, Wash. A more detailed general description of dot matrix line printers, is set forth in U.S. Pat. Nos. 3,768,403 and 3,782,278, both assigned to Tally Corporation.

While line printers of the type described in the foregoing paragraph have found widespread use as intermediate speed printers, attempts to increase the speed of such printers have not been as successful as desired. One problem that has been particularly difficult to overcome is the sideways vibrational hammer motion (e.g., vibratory hammer motion parallel to the direction of comb motion) that occurs as speed is increased. This sideways vibrational motion is due not only to dynamic forces, but also to magnetic cross-talk between print coils and adjacent print hammers not associated with a given coil during the print operation. As a result, the print hammers do not track in a straight forward-and-back motion, i.e., straight toward and away from the ribbon and paper. Sideways vibrational motion has the undesirable effect of causing the printing of dots that are out of position with respect to an ideal dot print matrix, particularly as printing speed is increased. As a result, the printed characters are not as clear and readable as desired.

Various suggestions have been made to solve the foregoing problem; however, these attempts have been unsuccessful for various reasons. In many cases, while they solved the sideways vibrational motion problem, they caused other print problems. For example, while the installation of caps on hammer tips that fill the space between adjacent hammers or the insertion of a silicone rubber adhesive across the hammer face, reduce or eliminate sideways vibrational motion, they caused other print problems. As a result, such solutions to the sideways vibrational motion problem are unacceptable. Another proposed solution was to bond print hammers and their associated dampers together to increase print hammer sideways rigidity. However, this technique seriously adversely affects print quality. As a result, this proposed solution is also unacceptable. The present invention is directed to overcoming the sideways vibrational motion problem without causing other problems.

It is an object of this invention to provide a mechanism for preventing or substantially reducing the sideways vibrational motion of the hammers of a line printer including a plurality of parallel hammers that are oscillated back and forth during printing.

It is another object of this invention to provide a new and improved hammer mechanism for a line printer.

It is yet another object of this invention to provide a mechanism for greatly reducing or entirely eliminating the sideways vibrational motion of a flexible member without impeding back and forth motion in a direction perpendicular to the direction of sideways motion.

SUMMARY OF THE INVENTION

In accordance with this invention, a half-herringbone support for reducing or entirely eliminating the sideways vibrational motion of the hammers of a dot matrix line printer is provided. The half-herringbone support is generally flat and includes a base. A series of parallel tines project obliquely outwardly from one edge of the base, in the plane of the base. The number of half-herringbone tines is equal to the number of hammers. The base of the half-herringbone support is affixed to the base of the hammer support and the tines of the half-herringbone support project outwardly to a point where they each intersect the mid-region of an associated hammer. The half-herringbone tines are affixed to the mid-region of a related hammer at the point of intersection.

Preferably, the tips of the half-herringbone tines are welded to their associated hammers, at the point of intersection. In addition, the region between the base of the half-herringbone support and the region where the tips of the tines are welded to the hammer tines is undercut, or releaved, such that a space exists between the half-herringbone tines and the hammers along substantially the entire length of the half-herringbone tines.

As will be appreciated from the foregoing summary, the invention provides an uncomplicated mechanism for eliminating or entirely reducing the sideways vibrational motion of the hammers, without impeding motion toward and away from the print paper, which motion is generally orthogonal to the undesired sideways vibrational motion. The tines of the half-herringbone support are of particular assistance in preventing sideways vibrational motion when the hammers attempt to move in the direction in which the half-herringbone tines point, i.e., motion to the right if the tines point toward the right. While sideways vibrational motion in the opposite direction (e.g., left for right pointing tines) is possible, more force than that necessary to vibrate an unsupported hammer is required to create such opposite direction sideways vibrational motion. Moreover, sideways vibrational motion restriction in one direction prevents buildup of resonant vibrational motion. The gaps between the half-herringbone tines and the hammers that extend substantially the entire length of the half-herringbone tines prevent rubbing between a particular half-herringbone tine and the hammers which it crosses, but with which it is not operatively associated, i.e., hammers other than the one to which a particular half-herringbone tine is welded.

BRIEF DESCRIPTION OF THE DRAWING

The foregoing objects and many of the attendant advantages of this invention will become more readily appreciated as the same becomes better understood by reference to the following detailed description when taken in conjunction with the accompanying drawing wherein:

FIG. 1 is a cross-sectional pictorial view illustrating the present invention mounted in a oscillating hammer-type line printer;

FIG. 2 is a pictorial, partial diagram illustrating a mechanism for oscillating the hammers of a hammer-type dot matrix line printer;

FIG. 3 is a front elevational view of a half-herringbone support formed in accordance with the invention;

FIG. 4 is an end view of the half-herringbone support illustrated in FIG. 3;

FIG. 5 is an elevational view of a half-herringbone support formed in accordance with the invention affixed to the hammers of a hammer-type dot matrix line printer; and, FIG. 6 is an end view of the assembly illustrated in FIG. 5.

DESCRIPTION OF THE PREFERRED EMBODIMENT

In order for the invention to be more easily understood, prior to describing the specific structure forming the present invention, a brief discussion of the general nature and operation of hammer-type dot matrix line printer with which the present invention is useful is generally described. For a more complete discussion of such a printer, reference is made of U.S. Pat. Nos. 3,768,403 and 3,782,278 noted above, and to publications of the Tally Corporation Kent, Wash. describing its Series 2000 Line Printer.

FIG. 1 is a cross-sectional pictorial view generally illustrating the print mechanism of a hammer-type line printer. The print mechanism includes a bar platen 11 having a print surface 13 located along one edge. Paper 15 moving in the direction of arrow A passes over the print surface 13 of the platen 11. The paper 15 may be moved or indexed a dot row distance, after each row of dots is printed, by a suitable tractor-type or other paper movement mechanism (not shown) well known in the line printer art. Located on the side of the paper 15 remote from the platen 11 is a ribbon 17. Normally the ribbon 17 is moved in a direction perpendicular to the direction of paper movement (i.e., orthogonal to the plane of the FIG. 1 cross-sectional view) from a supply reel to a take-up reel. A suitable indexing mechanism (not shown), may index the ribbon 17 a predetermined distance after each line of dots is printed.

Located on the side of the ribbon 17 remote from the paper 15 is a series of hammers 19. The hammers 19 are formed of a suitable spring steel and, as better illustrated in FIG. 2, define a comb like structure 18. That is, the hammers 19 are formed by the tines of a comb like structure 18 that includes a base 20 and a series of parallel legs (tines) projecting outwardly in the plane of the base 20 from one edge thereof as illustrated best in FIGS. 5 and 6. Each tine forms a hammer 19. Located near the outer end of each hammer 19 on the side nearest the ribbon 17, and adjacent to the ribbon 17, is a suitable dot print creating mechanism such as a ball 21. Preferably, a damper mechanism is located on the side of each hammer 19 remote from the ball side, near the base of the hammer assembly 41. The illustrated damper mechanism comprises a plurality of damper tines 25, one associated with each hammer.

The entire hammer assembly 41 (comb and damper mechanism) is affixed at its base to a suitable support 27. The support 27 is located on the side of the damper tines 25 remote from the damper tines 25. The hammer assembly 41 is, preferably, affixed to the support 27 by a series of bolts that pass through apertures in the base of the hammer assembly 41 and screw into the support 27.

Located on the side of the hammers 19 remote from the ribbon 17 are a series of print coils 29. Preferably, one print coil 29 is associated with each hammer 19. As the hammers 19 are moved back and forth (in and out of the plane of the view of FIG. 1), the print coils 29 are selectively energized. When a particular coil 29 is energized, its related hammer 19 is withdrawn, i.e., moved away from the ribbon 17 (toward the right as viewed in FIG. 1). When the stored hammer strain energy is released, the ball 21 of the related hammer 19 moves into contact with the ribbon 17 and presses the ribbon 17 against the paper 15 causing a dot to be printed. As a result, as the hammers 19 are moved back and forth, and the print coils 29 are selectively energized, a series of dots are formed on the paper 15. Row/column dot arrays (e.g., a dot matrix) form characters.

FIG. 2 illustrates a mechanism for mogating or oscillating the hammers 19 back and forth, in the direction illustrated by arrow B, during printing. In the illustrated mechanism, a vertical shaft 31 is oscillated by a suitable oscillating mechanism (not shown) through a predetermined angle, such as 15 degrees. A shaft bracket 33 is mounted on the upper end of the shaft 31. A flexure linkage 35 connects the shaft bracket 33 to a hammer bracket 37. The hammer bracket 37 in turn is coupled to a support flexure 39. This support flexure 39 and another similar support flexure located at the other end of the hammer assembly 41 support the hammer assembly 41. The overall flexure arrangement oscillates the hammer assembly 41 back and forth as the shaft 31 is oscillated.

While hammer-type dot matrix line printers of the type generally described above have found widespread use at intermediate speeds, it has been found that the hammers 19 unduly vibrate in a sideways direction i.e., in the direction of comb movement, as speed is increased. This sideways vibrational motion imposed on the hammers 19 results in dots being printed out of position, i.e., at positions different than ideal dot positions. Consequently, the resultant characters are not as clear and precise as desirable. The present invention overcomes this problem by adding a half-herringbone support 51 (FIG. 1) to the hammer assembly 41 on the same side as the print balls 21 are located. The half-herringbone support 51 acts as a physical constraint that greatly reduces the sideways vibrational motion of the print hammers 19, without appreciably affecting hammer forward and backward motion during normal printing. FIGS. 3 and 4 illustrate a half-herringbone support 51 formed in accordance with the invention; and, FIGS. 5 and 6 illustrate the half-herringbone support 51 attached to the hammers 19.

The half-herringbone support 51 includes an elongate base 53 and a plurality of tines 55. The elongate base 53 is generally flat and the tines 55, which are integrally formed with said base 53, project outwardly in an oblique direction from one edge of the base 53, in the plane of the base 53. The half-herringbone support 51 is formed of a suitably rigid metal, such as 0.020 thick, Type 321 stainless steel, 2B or 2D finish, annealed. (Obviously, other types of suitably rigid metals of suitable thicknesses can be used, as desired.) Preferably, the grain direction of the metal is perpendicular to the longitudinal axis of the base 53. The base 53 includes a plurality of apertures 56 that allow it to be attached along with the hammer assembly 41 to the support 27 (FIG. 1) by the bolts previously described.

As best illustrated in FIG. 3, on the side facing the hammers 19, the half-herringbone tines 55, between their tips 57 and the base 53, are undercut. The undercut regions 59, as will be better understood from the following description, prevents rubbing between the half-herringbone tines 55 and the hammers 19 over which the half-herringbone tines 55 pass, but with which they are not associated.

FIGS. 5 and 6 illustrate the manner of attachment of the half-herringbone support 51 to the hammers 19. The half-herringbone support 51 is attached to the hammer assembly 41 by aligning the base 53 of the half-herringbone support 51 with the base 20 of the comb 18. The tines 55 of the half-herringbone support 51 are formed such that when the base 53 of the half-herringbone support 51 and the hammer assembly 41 are suitably aligned, the outer tips 57 of the half-herringbone tines 55 intersect the hammers 19 near the midpoints of the hammers 19. At these intersections the half-herringbone tines 55 are welded to the hammers 19.

It will be appreciated from the foregoing description that each tine 55 of the half-herringbone support 51 is associated with a print hammer 19. The half-herringbone support base 53 is clamped to the comb base 20 by the bolts that pass through the apertures in both bases 20, 53 and attach the bases 20, 53 to the support 27. As the print hammers are moved back and forth, i.e., toward and away from the ribbon 17, the half-herringbone tines flex. Thus, in the print direction of motion, the half-herringbone support 51 does not restrict print hammer action. However, when the print hammers 19 attempt to vibrate in a sideways direction, i.e., in the direction of hammer oscillatory movement, depicted by arrow B in FIG. 2, the half-herringbone tines 55 perform their restrictive function. More specifically, the half-herringbone tines 55 restrict vibration motion in the sideways or oscillator direction of hammer movement. Attempted movement in the direction of tine pointing, e.g., rightward in FIG. 5, results in an attempt to stretch the half-herringbone tines 55. Since the tines 55 do not stretch, such motion is prevented or, at least, substantially restricted. While sideways motion in the opposite direction, e.g., leftward in FIG. 5, is possible, such motion still requires more sideways force than would be required for an unsupported tine 55 to move sideways in this direction. Even if such movement occurs, it is severely restricted because sideways motion restriction in one direction, e.g., to the right, prevents resonant vibration. Thus, while the tines 55 may move one way, they will not resonate (move both ways) to any significant degree.

As briefly noted above, the gap formed by the undercut region 59 prevents rubbing and bumping between the half-herringbone tines 55 and the hammers 19 over which a particular half-herringbone tine 55 passes, but with which it is not associated. This gap is required because a particular print hammer 19 and its half-herringbone tine 55 may be moving back at the same time an adjacent hammer 19 (over which the same half-herringbone tine 55 passes) is moving forward.

It will be appreciated from the foregoing discussion that the invention provides a mechanism for supporting the hammers 19 of a hammer-type line printer. The mechanism prevents or severely restricts sideways vibratory movement of the hammers 19 without restricting normal printing motion. As a consequence, the imprinted characters remain clear, even though the speed of oscillatory movement of the hammers 19 is substantially increased over the oscillatory speed of prior art hammers.

While a preferred embodiment of the invention has been illustrated and described, it will be appreciated by those skilled in the art and others that various changes can be made therein without departing from the spirit and scope of the invention. For example, while the half-herringbone tines 55 are illustrated as pointing toward the right in FIG. 5, the tines 55 could point toward the left, if desired. Further, the metal used to form the half-herringbone support 51 can be other than the one specifically described. For example, 0.025 thick type 304L or 316L stainless steel ¼ hard, may be more suitable in some environments. Hence, the invention can be practiced otherwise than as specfically described herein.

The embodiments of the invention in which an exclusive property or privilege is claimed are defined as follows:

1. In a dot matrix printer including a plurality of closely spaced, dot imprinting hammers projecting outwardly from a base so as to lie in a common plane, said hammers being oscillated back and forth in a direction perpendicular to the direction of hammer movement that occurs during printing, the improvement comprising a half-herringbone support for decreasing the vibratory motion of said hammers in the direction of oscillation of said hammers, said half-herringbone support comprising an elongate planar base and a plurality of tines integrally formed with said elongate planar base of said half-herringbone support and projecting obliquely outwardly from one of the longitudinal edges of said elongate planar base of said half-herringbone support so as to lie in the plane of said elongate planar base of said half-herringbone support, said elongate planar base of said half-herringbone support attached to the base from which said plurality of hammers project such that the plane of said hammers and the plane defined by said elongate planar base of said half-herringbone support and said plurality of tines of said half-herringbone support are juxtaposed, said half-herringbone support positioned such that each of said plurality of tines overlie one or more of said plurality of hammers and such that the outer tip of each of said tines intersects an associated hammer at a point intermediate the ends of said associated hammer, said outer tips of said tines being permanently affixed to their associated hammers at the points of intersection, the portion of said tines lying between the base of said half-herringbone support and the tips of said tines being undercut on the side of said tines facing said hammers so as to prevent rubbing between said tines and the hammers over which said tines pass but to which said tines are not permanently affixed.

2. The improvement claimed in claim 1 wherein said half-herringbone support is formed of a metal having a predetermined grain direction, said grain direction being substantially perpendicular to the longitudinal direction of said elongate planar base of said half-herringbone support.

3. The improvement claimed in claim 2 wherein the tips of the tines are welded to their associated hammers.

4. The improvement claimed in claim 1 wherein the tips of the tines are welded to their associated hammers.

* * * * *